US009664164B2

(12) United States Patent
Imakita et al.

(10) Patent No.: US 9,664,164 B2
(45) Date of Patent: May 30, 2017

(54) FUEL-PIPING ATTACHMENT STRUCTURE

(71) Applicant: HONDA MOTOR CO., LTD., Tokyo (JP)

(72) Inventors: Akio Imakita, Wako (JP); Fumio Kaneda, Wako (JP); Hiroyuki Kojima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 458 days.

(21) Appl. No.: 14/071,656

(22) Filed: Nov. 5, 2013

(65) Prior Publication Data

US 2014/0123951 A1 May 8, 2014

(30) Foreign Application Priority Data

Nov. 8, 2012 (JP) ..... 2012-246521

(51) Int. Cl.
*F02M 55/02* (2006.01)
*F02M 61/14* (2006.01)
*F02M 69/46* (2006.01)

(52) U.S. Cl.
CPC ..... *F02M 55/025* (2013.01); *F02M 61/14* (2013.01); *F02M 69/465* (2013.01); *F02M 2200/185* (2013.01); *F02M 2200/855* (2013.01); *F02M 2200/857* (2013.01)

(58) Field of Classification Search
CPC ..... F02M 69/462; F02M 15/06; F02M 55/02; F02M 55/025; F02D 17/04; F02B 77/13; B60K 5/00
USPC ..... 123/469, 456, 468, 198 D, 198 E; 180/195, 232
See application file for complete search history.

(56) References Cited

U.S. PATENT DOCUMENTS 6,076,505 A * 6/2000 Guggenmos ..... F02F 1/242 123/195 C
6,510,833 B1 * 1/2003 Anthon ..... B32B 5/26 123/198 E
6,513,500 B2 * 2/2003 Braun ..... F02M 69/465 123/456
7,004,146 B1 * 2/2006 Kato ..... F02M 55/025 123/467
8,028,673 B2 * 10/2011 Olsen ..... F02B 77/00 123/198 D
8,677,972 B2 * 3/2014 Kim ..... F02M 35/10216 123/184.61
9,074,565 B2 * 7/2015 Ramamurthy ..... F16L 55/04
2004/0007212 A1 * 1/2004 Kato ..... 123/494
(Continued)

FOREIGN PATENT DOCUMENTS

JP 2006-046330 2/2006

*Primary Examiner* — Sizo Vilakazi
(74) *Attorney, Agent, or Firm* — Mori & Ward, LLP

(57) ABSTRACT

A fuel-piping attachment structure includes a fuel piping, at least one fastening portion, and a protective member. The at least one fastening portion is to be joined to an internal combustion engine main body to support the fuel piping with respect to the internal combustion engine main body. The protective member includes at least one base portion to be joined to the internal combustion engine main body. All of the at least one fastening portion are disposed on a first side in a Z direction with respect to the axis of the fuel piping. All of the at least one base portion are disposed on a second side in the Z direction with respect to the axis of the fuel piping.

15 Claims, 16 Drawing Sheets

(56) References Cited

U.S. PATENT DOCUMENTS

| | | | | |
|---|---|---|---|---|
| 2006/0005800 | A1* | 1/2006 | Fujii | 123/195 C |
| 2009/0107450 | A1* | 4/2009 | Olsen | F02B 77/00 123/195 C |
| 2014/0123951 | A1* | 5/2014 | Imakita et al. | 123/469 |

* cited by examiner

FUEL-PIPING ATTACHMENT STRUCTURE

CROSS-REFERENCE TO RELATED APPLICATIONS

The present application claims priority under 35 U.S.C. §119 to Japanese Patent Application No. 2012-246521, filed Nov. 8, 2012, entitled "Attachment Structure of Fuel Piping." The contents of this application are incorporated herein by reference in their entirety.

BACKGROUND

1. Field

The present disclosure relates to a fuel-piping attachment structure.

2. Description of the Related Art

In a vehicular engine, in order to protect fuel piping that supplies fuel to injectors from the load at the time of collision, the side of the fuel piping opposite to the cylinder block is covered with a protective member (protector) (see, for example, Japanese Unexamined Patent Application Publication No. 2006-46330). In the related art according to Japanese Unexamined Patent Application Publication No. 2006-46330, the engine is placed laterally such that the cylinder row direction is parallel to the vehicle width direction, the fuel piping extends in the cylinder row direction in front of the cylinder head, and the protective member extends vertically in front of the fuel piping and is fastened to the cylinder head at the upper and lower ends thereof. The protective member has a deformable portion that deforms in response to a load from the front and absorbs the load, and a stopper that comes into contact with the cylinder head and secures a predetermined gap between the protective member and the fuel piping when the deformable portion deforms.

SUMMARY

According to one aspect of the present invention, a fuel-piping attachment structure includes a fuel piping, at least one fastening portion, and a protective member. The fuel piping extends parallel to an injector row including a plurality of injectors aligned in an internal combustion engine main body. The at least one fastening portion is to be joined to the internal combustion engine main body to support the fuel piping with respect to the internal combustion engine main body. The protective member includes at least one base portion to be joined to the internal combustion engine main body. The protective member extends so as to cover a side of the fuel piping opposite to the internal combustion engine main body. The protective member has a distal end forming a free end. A direction perpendicular to a direction of axes of the plurality of injectors and a direction of axis of the fuel piping is defined as a Z direction. All of the at least one fastening portion are disposed on a first side in the Z direction with respect to the axis of the fuel piping. All of the at least one base portion are disposed on a second side in the Z direction with respect to the axis of the fuel piping.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
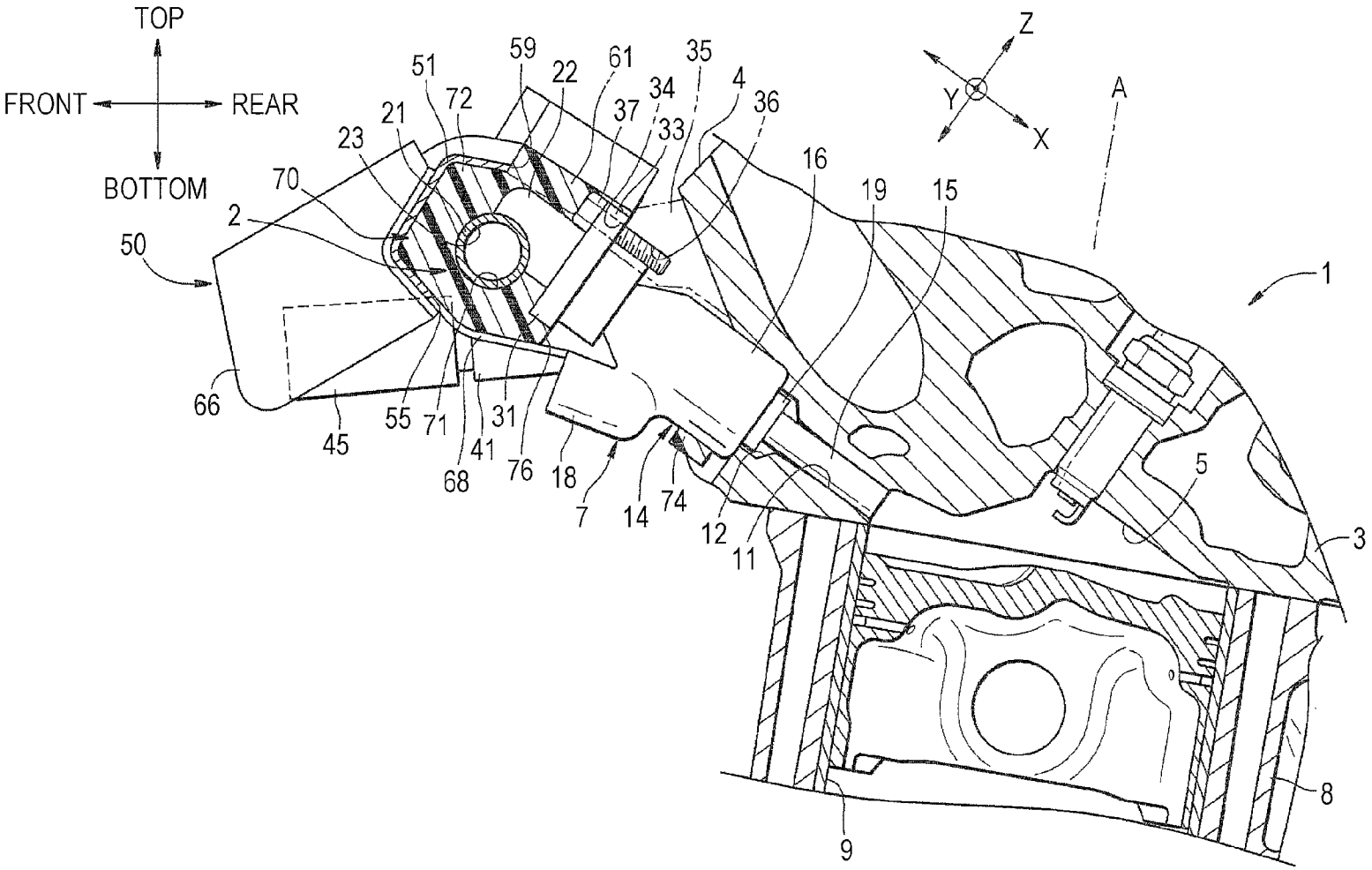
FIG. 1 is a sectional view showing an engine having a fuel piping assembly according to an embodiment (sectional view taken along line I-I of FIG. 3).

The embodiments will now be described with reference to the accompanying drawings, wherein like reference numerals designate corresponding or identical elements throughout the various drawings.

An example in which the present disclosure is applied to fuel piping of a straight four-cylinder in-cylinder injection type engine will now be described with reference to the drawings. In the following description, "front-rear", "left-right", and "top-bottom" directions are defined based on a vehicle in which an engine 1 is mounted. The engine 1 is mounted transversely in the vehicle such that the cylinder row direction is parallel to the left-right direction. Fuel piping 2 is provided along a front wall 4 along the cylinder row direction of a cylinder head 3 of the engine 1, and distributes fuel pressure-fed from a fuel pump (not shown) to injectors 7 provided so as to correspond to combustion chambers 5 of the cylinder head 3.

As shown in FIG. 1, the cylinder head 3 has four combustion chambers 5 corresponding to four cylinders 9 aligned in a cylinder block 8, and four injector insertion holes 11 communicating with the combustion chambers 5 from the outer surface of the front wall 4 along the cylinder row direction (left-right direction). The four injector insertion holes 11 have axes parallel to each other, and are aligned parallel to the cylinder row direction. Each injector insertion hole 11 is a through-hole that is circular in cross-section, and has, at the front wall 4 side open end thereof, an increased diameter open end 12 whose diameter is increased, with a stepped portion therebetween.

Each injector 7 has a tubular housing 14, and therein a fuel passage (not shown), a valving element (not shown) that opens and closes the fuel passage, and an actuator (not shown) that drives the valving element. The housing 14 has a distal end portion 15 and a proximal end portion 16 wider than the distal end portion 15. The distal end portion 15 and the proximal end portion 16 are coaxial along a predetermined axis. A connector 18 for connecting the injector 7 to a control unit and a power source is protruded from the side of the proximal end portion 16. The connector 18 protrudes in the radial direction of the proximal end portion 16 and then bends and extends to the proximal end portion side. The terminal portion of the connector 18 faces the proximal end portion side. An increased diameter portion 19 whose diameter is increased relative to that of the distal end portion 15 is provided at the border between the distal end portion 15 and the proximal end portion 16. The fuel passage of the injector 7 extends from the end face of the proximal end portion 16 through the inside of the injector 7 to the end face of the distal end portion 15.

Each injector 7 is disposed coaxially with a corresponding one of the injector insertion holes 11 by inserting the distal end portion 15 into the injector insertion hole 11 and disposing the increased diameter portions 19 at the increased diameter open end 12. The end face of the proximal end portion 16 closest to the distal end portion 15 comes into contact with the open end face of the injector insertion hole 11, and the insertion depth of the injector 7 into the injector insertion hole 11 is thereby defined. A plurality of O-rings (not shown) are interposed between the outer peripheral surface of the distal end portion 15 of the injector 7 and the inner peripheral surface of the injector insertion hole 11, and sealing is performed. The rotational position of the injector 7 relative to the injector insertion hole 11 is determined such that the connector 18 is located below the proximal end portion 16. In a state where the injectors 7 are attached to the cylinder head 3, the direction in which the axes of the injectors 7 extend will be referred to as injector axis direction X. The direction in which the plurality of injectors 7 are aligned (the direction parallel to the left-right direction) will be referred to as injector row direction.

Figure 5:
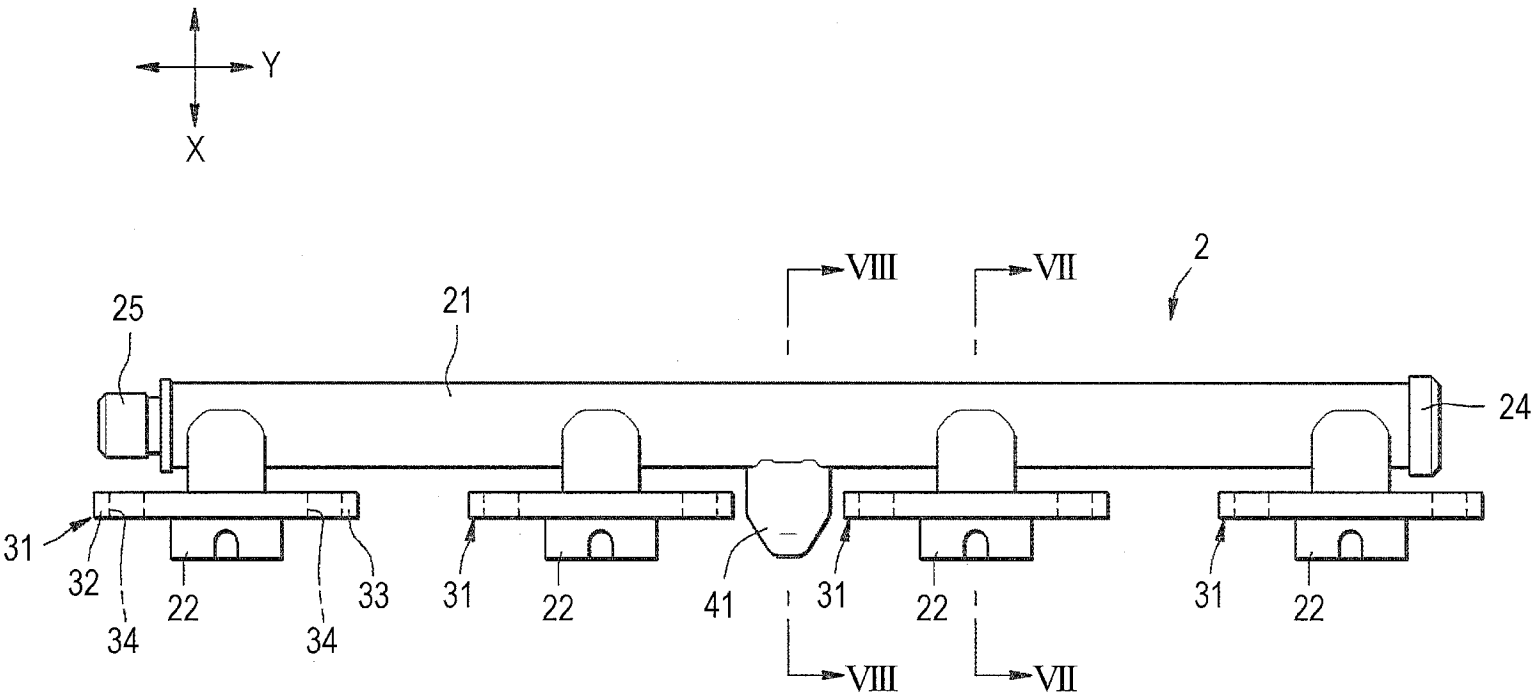
FIG. 5 is a plan view of fuel piping.
Figure 6:
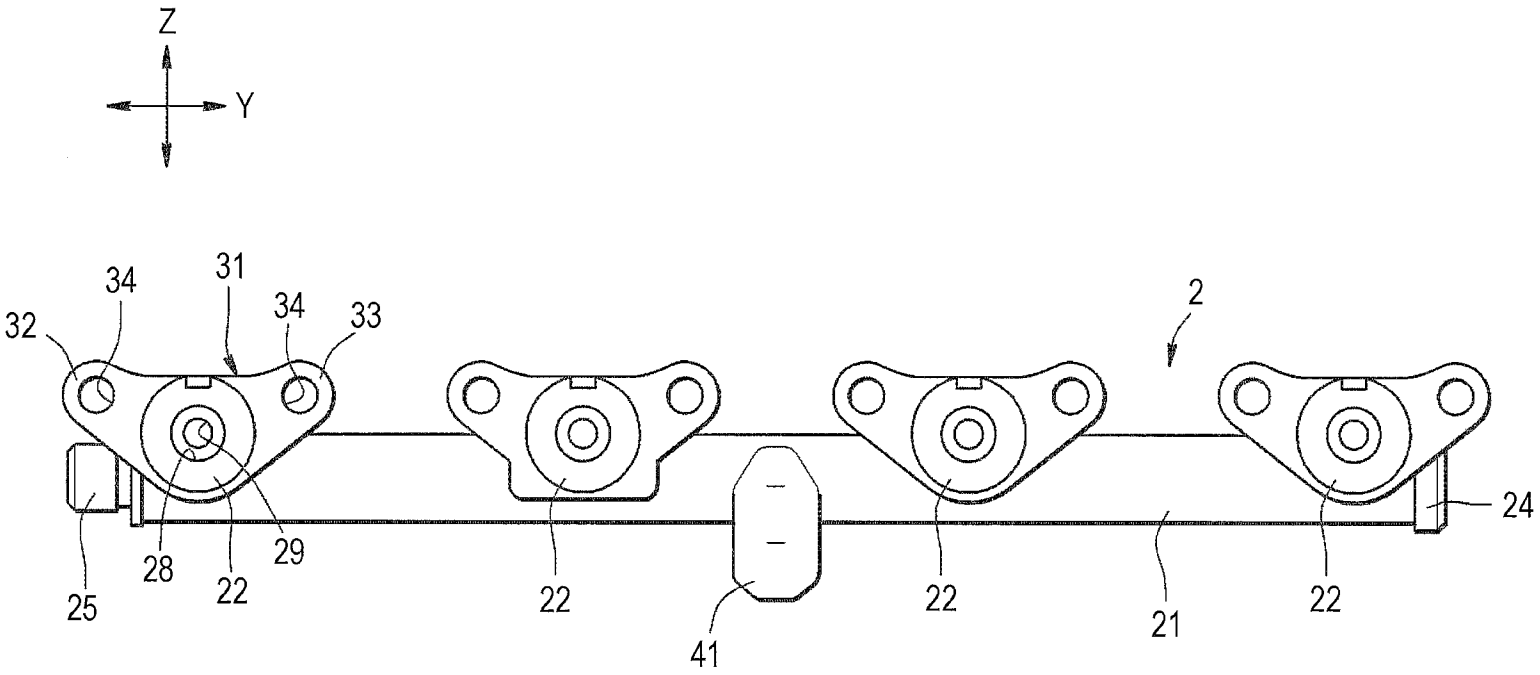
FIG. 6 is a side view of the fuel piping.

As shown in FIG. 1, FIG. 5, and FIG. 6, the fuel piping 2 has a main pipe 21 extending on the side of the front wall 4 of the cylinder head 3, parallel to the injector row, and four branch pipes 22 protruding from the main pipe 21. The direction in which the axis of the main pipe 21 extends will be referred to as main pipe axis direction Y. In this embodiment, the main pipe axis direction Y is parallel to the left-right direction (the cylinder row direction, the injector row direction). The direction perpendicular to each of the main pipe axis direction Y and the injector axis direction X will be referred to as Z direction.

Figure 2:
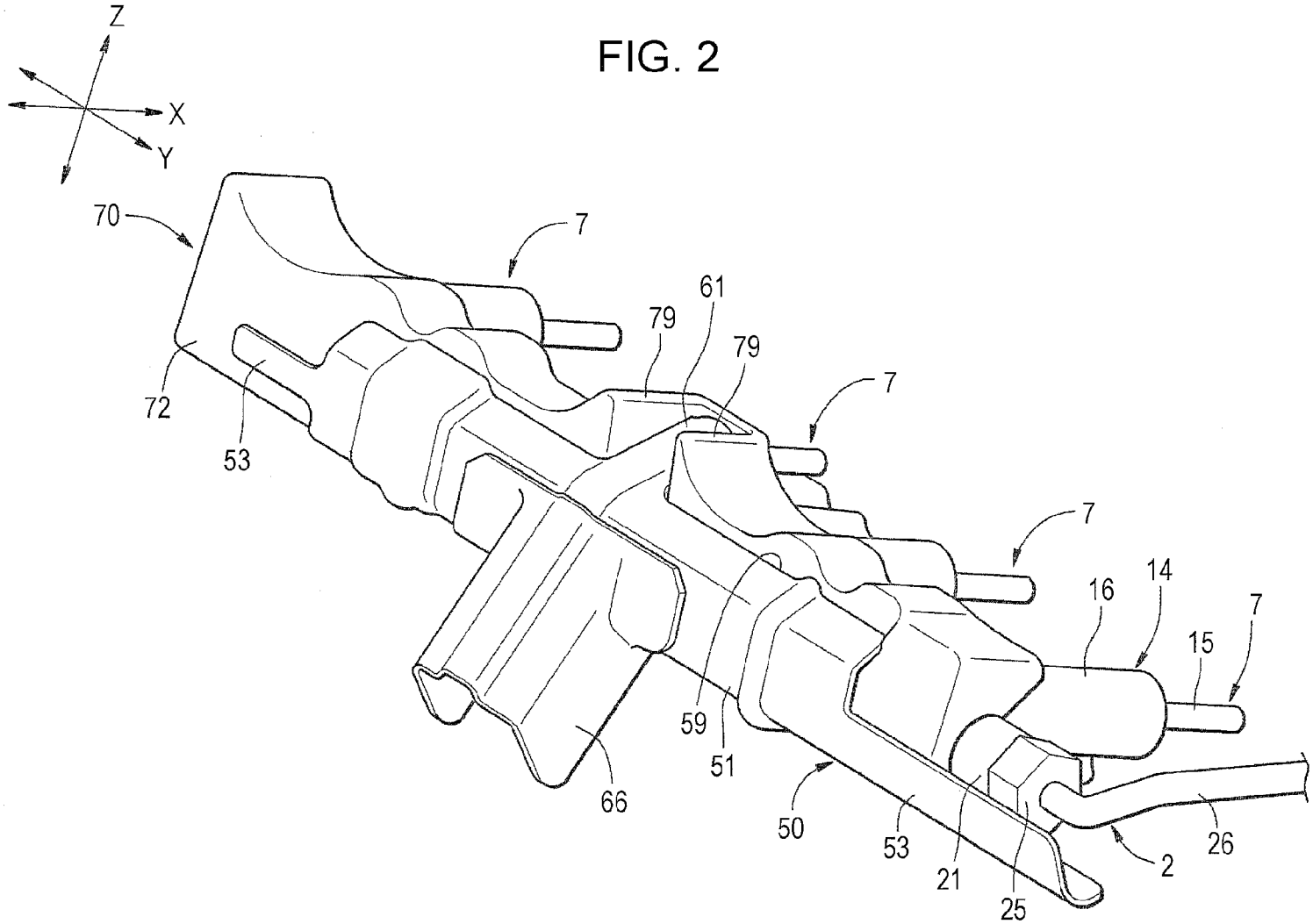
FIG. 2 is a perspective view of the fuel piping assembly.

As shown in FIG. 5 and FIG. 6, the main pipe 21 is a circular pipe having an inner hole 23 (see FIG. 7), one end in the longitudinal direction is blocked by a cap 24, and the other end is continuous through a joint 25 with a pipe 26 (see FIG. 2) connected to the fuel pump. As shown in FIG. 1, the injectors 7 are disposed on a first side in the Z direction (obliquely upper side in FIG. 1) of the main pipe 21.

Figure 7:
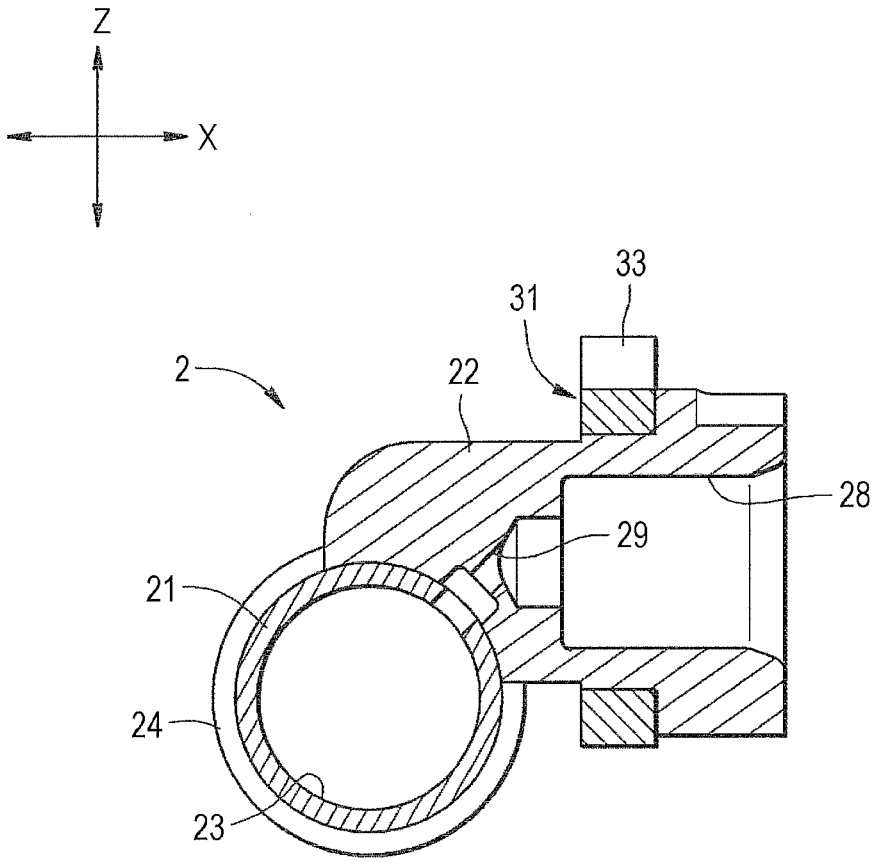
FIG. 7 is a sectional view taken along line VII-VII of FIG. 5.

As shown in FIG. 5 to FIG. 7, each branch pipe 22 extends linearly, and is connected at its proximal end to the first side (injector 7 side) in the Z direction of the main pipe 21 by welding or the like. The axes of the branch pipes 22 extend along a plane perpendicular to the axis of the main pipe 21, and are disposed so as to be parallel to each other. The branch pipes 22 are offset to the first side in the Z direction from the main pipe 21 so that the axes of the branch pipes 22 do not intersect with the axis of the main pipe 21. As shown in FIG. 7, in the distal end face of each branch pipe 22, an injector connecting hole 28 that is open along the axis of the branch pipe 22 is formed. The injector connecting hole 28 is continuous with the inner hole 23 of the main pipe 21 through a connecting hole 29 extending in the branch pipe 22 in the radial direction of the main pipe 21. The end of the proximal end portion 16 of the injector 7 is inserted into the injector connecting hole 28, and the axis of the branch pipe 22 is disposed coaxially with the axis of the injector 7. An O-ring (not shown) is interposed between the outer surface of the proximal end portion 16 and the inner surface of the injector connecting hole 28, and sealing is performed. Fuel supplied to the main pipe 21 passes through the connecting hole 29 of the branch pipe 22 and the injector connecting hole 28 in this order, and is supplied to the proximal end portion 16 of the injector 7.

As shown in FIG. 5 to FIG. 7, a fastening flange 31 joined by welding or the like is protruded from the outer surface of the distal end portion of each branch pipe 22. As shown in FIG. 6, the fastening flange 31 has a first fastening portion 32 extending from the branch pipe 22 to a first side in the main pipe axis direction Y and the first side (injector 7 side) in the Z direction, and a second fastening portion 33 extending from the branch pipe 22 to a second side in the main pipe axis direction Y and the first side in the Z direction. The first fastening portion 32 and the second fastening portion 33 each have a fastening surface facing the distal end side of the branch pipe 22, and a bolt insertion hole 34 that is a through-hole extending in the direction of axis of the branch pipe 22. Each bolt insertion hole 34 is offset to the first side in the Z direction from the main pipe 21 so as not to overlap with the main pipe 21 when viewed from a direction along the injector axis direction X.

As shown in FIG. 1, the fastening flange 31 is disposed such that the first fastening portion 32 and the second fastening portion 33 are in contact with a fastening seat 35 formed on the front wall 4 of the cylinder head 3, and is fastened to the fastening seat 3 by bolts 37 screwed through the bolt insertion holes 34 into internally threaded holes 36 formed in the fastening seat 35. Thus, the fuel piping 2 including the branch pipes 22 and the main pipe 21 is fixed to the cylinder head 3, and each injector 7 is sandwiched between a corresponding one of the branch pipes 22 and the cylinder head 3.

Figure 8:
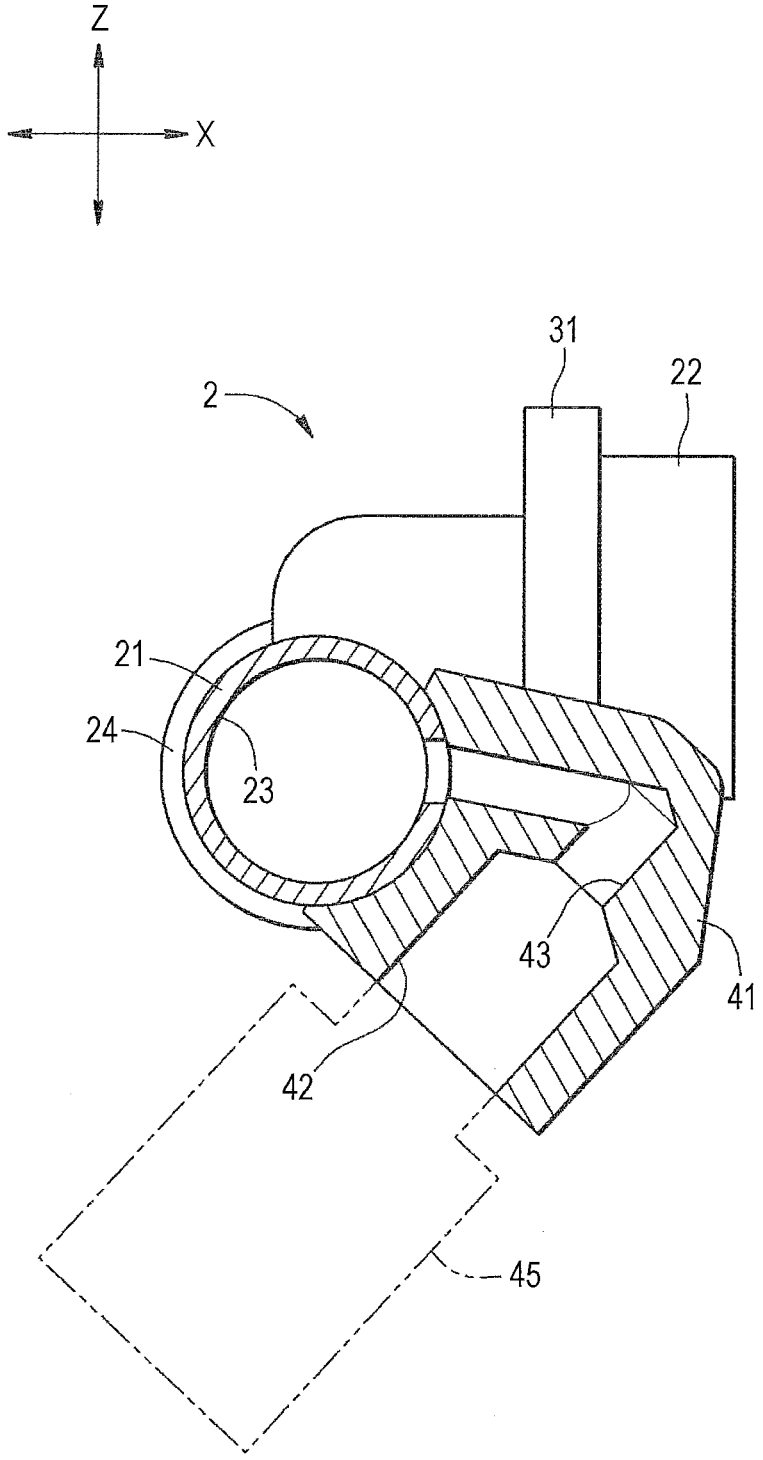
FIG. 8 is a sectional view taken along line VIII-VIII of FIG. 5.

As shown in FIG. 5 and FIG. 6, a sensor connecting portion 41 is formed in the longitudinal center of the main pipe 21 and between the central two of the four branch pipes 22. The sensor connecting portion 41 is joined by welding to the main pipe 21 so as to protrude to the side opposite to the injectors 7 (the second side) in the Z direction of the main pipe 21. As shown in FIG. 8, the sensor connecting portion 41 has a sensor receiving hole 42 that is open to the side opposite to the front wall 4 of the cylinder head 3, and a sensor connecting hole 43 that connects the sensor receiving hole 42 and the inner hole 23 of the main pipe 21. The sensor connecting hole 43 extends from the inner hole 23 of the main pipe 21, substantially parallel to the injector axis direction X, toward the cylinder head 3, then bends substantially at a right angle, and extends to the sensor receiving hole 42. One end of a fuel pressure sensor 45 having a substantially columnar outer shape is inserted into and fixed to the sensor receiving hole 42. The pressure of fuel in the main pipe 21 is applied through the sensor connecting hole 43 and the sensor receiving hole 42 to the fuel pressure sensor 45, and the fuel pressure sensor 45 detects the pressure of fuel in the main pipe 21.

As shown in FIG. 1 to FIG. 4, a protective member 50 for protecting the fuel piping 2 is provided on the front wall 4 of the cylinder head 3. The protective member 50 has a main body portion 51 that extends in the main pipe axis direction Y so as to cover the side of the main pipe 21 opposite to the cylinder head 3 with a gap therebetween, and a pair of base portions 52 that extend from the second side (the side opposite to the injector 7 side) in the Z direction of the main body portion 51 to the front wall 4 of the cylinder head 3 and are fastened to the front wall 4. The main body portion 51 and the base portions 52 are formed by forming a continuous steel sheet.

Figure 4:
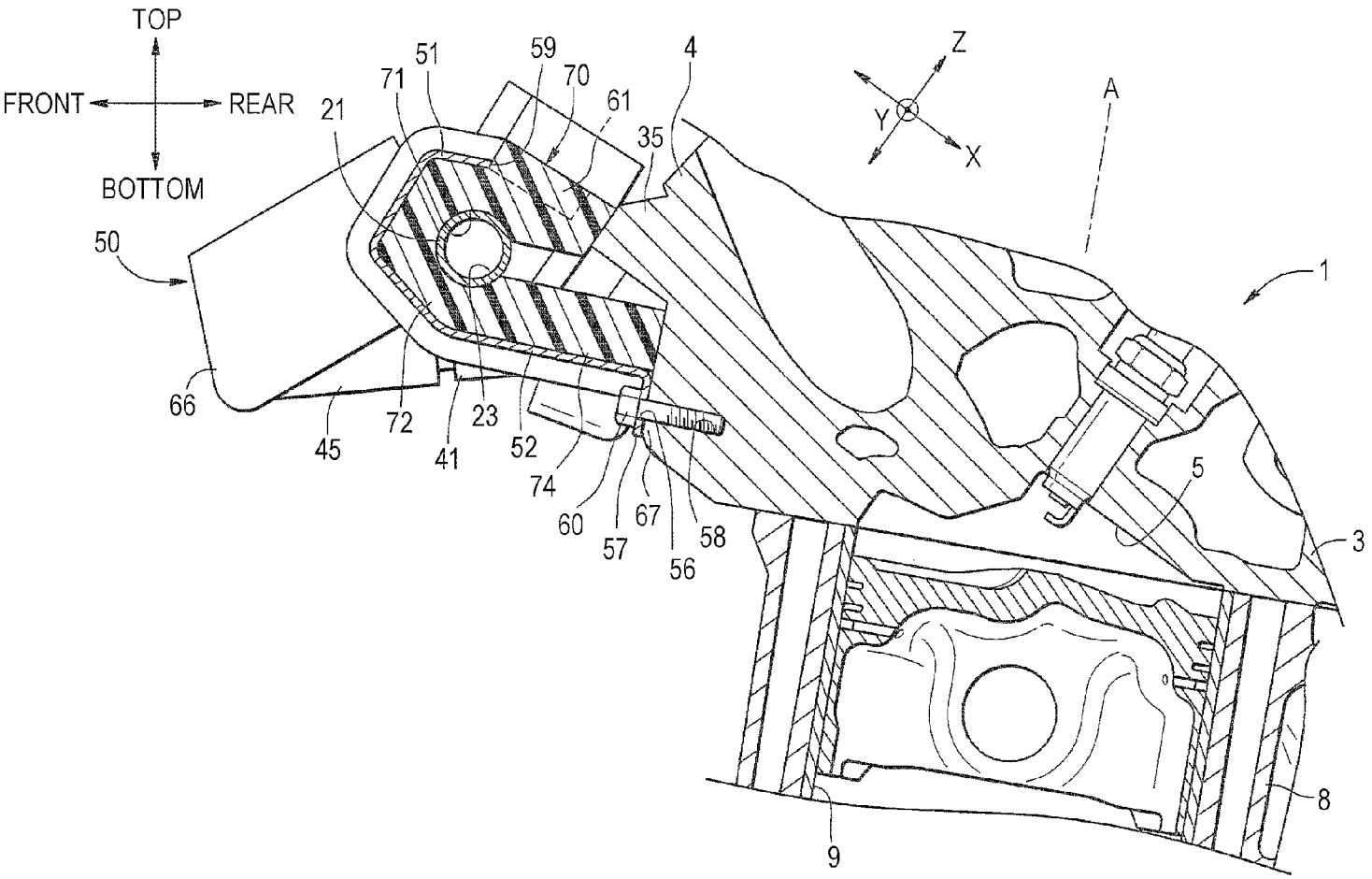
FIG. 4 is a sectional view taken along line IV-IV of FIG. 3.
Figure 9:
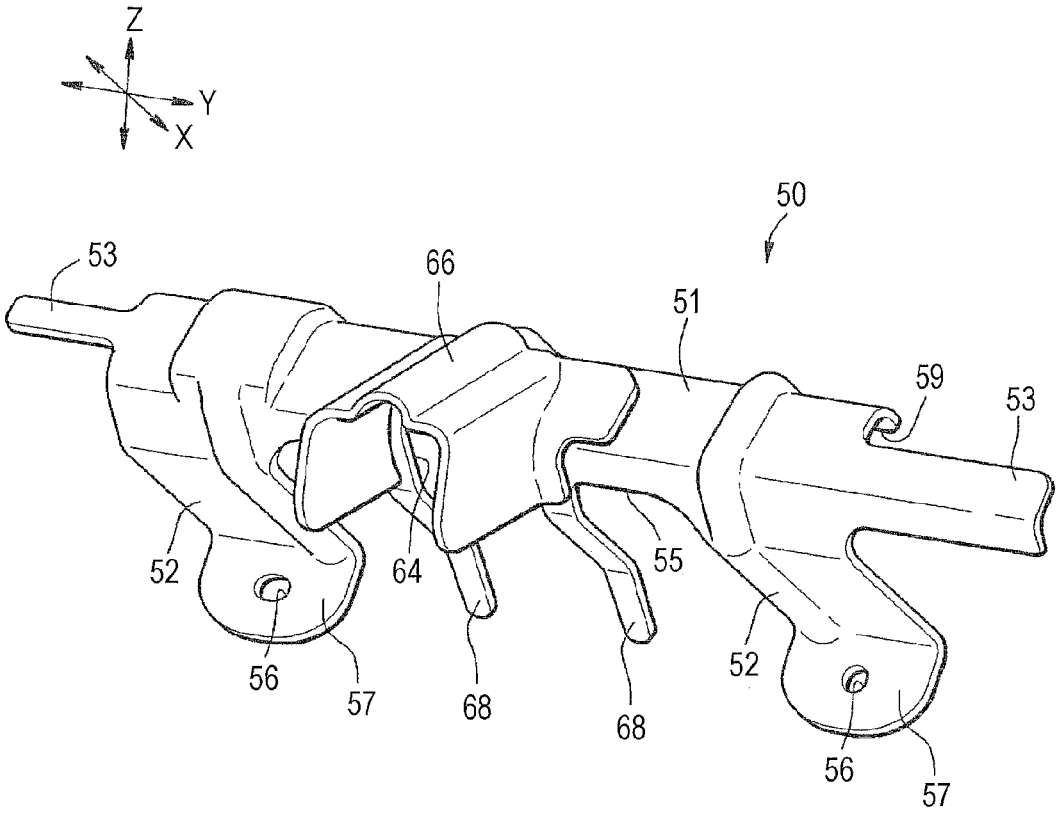
FIG. 9 is a front perspective view of a protective member.
Figure 10:
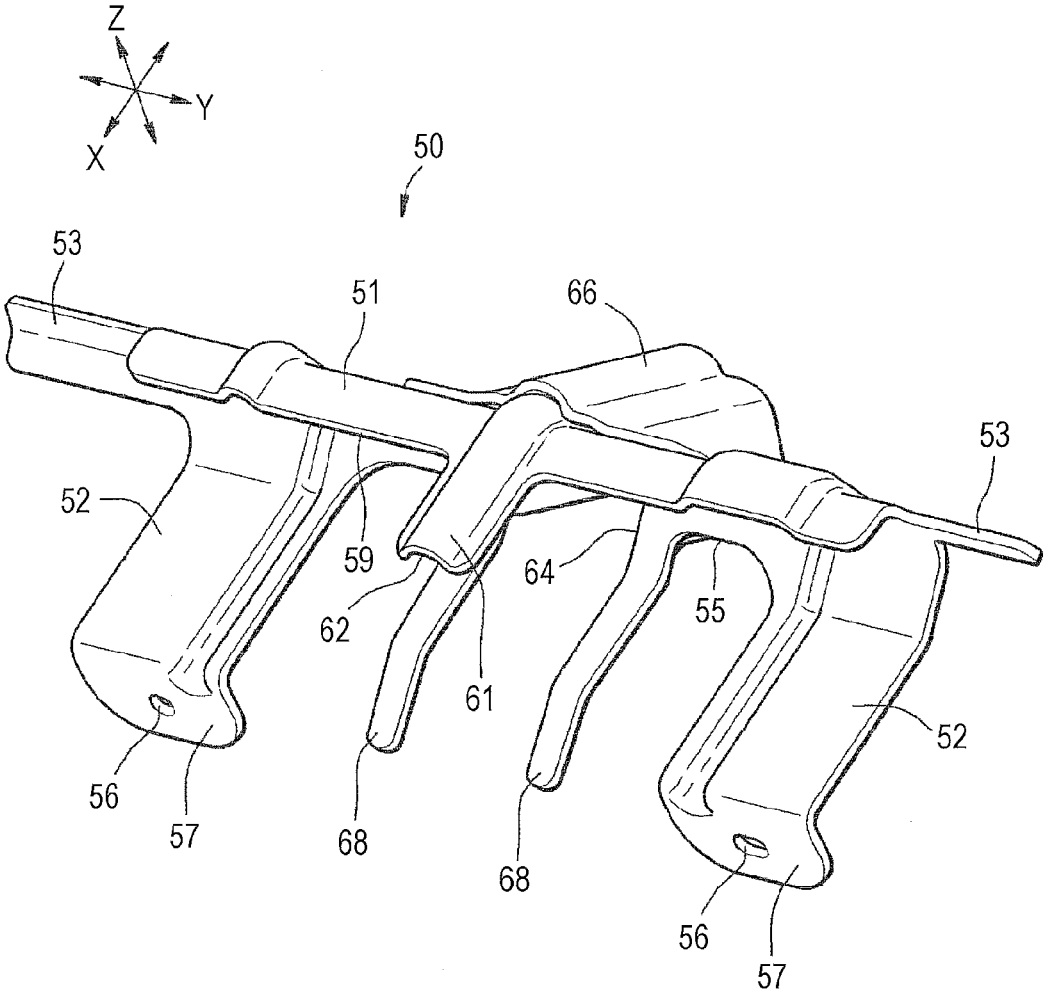
FIG. 10 is a rear perspective view of the protective member.

The main body portion 51 has a groove-shaped (U-shaped) cross-section that is open on the cylinder head 3 side, and receives a large portion in the longitudinal direction of the main pipe 21 in the groove shape with a gap therebetween. As shown in FIG. 9 and FIG. 10, plate-like extended portions 53 extending along the main pipe axis direction Y are provided at both longitudinal ends of the main body portion 51. The side of the main pipe 21 opposite to the cylinder head 3 is covered throughout its length by the main body portion 51 and the pair of extended portions 53. As shown in FIG. 1, FIG. 9, and FIG. 10, the edge on the second side in the Z direction (the proximal end edge 55) of the main body portion 51 is disposed on the second side in the Z direction of the main pipe 21. As shown in FIG. 4, the pair of plate-like base portions 52 extend from both longitudinal ends of the proximal end edge 55, through the second side in the Z direction of the main pipe 21, to the front wall 4 of the cylinder head 3. The protruding end of each base portion 52 is bent substantially at a right angle, and forms a fastening portion 57 having a bolt insertion hole 56 in its center. As shown in FIG. 4, each fastening portion 57 is placed against a fastening seat 67 of the front wall 4 of the cylinder head 3, and is fastened by a bolt 60 screwed into a bolt hole 58 formed in the fastening seat 67. Each base portion 52 is disposed between the injectors 7 so as not to interfere with the injectors 7. The fastening portion 57 of each base portions 52 is disposed on the second side in the Z direction of the main pipe 21.

As shown in FIG. 1, the edge on the first side in the Z direction (the distal end edge 59) of the main body portion 51 is a free end, is disposed on the first side in the Z direction of the main pipe 21, and faces the fastening flanges 31 from a direction along the injector axis direction X with a gap therebetween. As shown in FIG. 1 and FIG. 10, a first protrusion 61 is formed in the longitudinal center of the distal end edge 59. The first protrusion 61 extends through the first side in the Z direction of the main pipe 21, to the front wall 4. The distal end of the first protrusion 61 faces the front wall 4 with a predetermined distance therebetween. The distance between the first protrusion 61 and the front wall 4 is set smaller than any one of the distance between the distal end edge 59 and the fastening flanges 31 and the distance between the distal end edge 59 and the heads of the bolts 37 fastening the fastening flanges 31. Thus, when the main body portion 51 of the protective member 50 is subjected to a load and deforms toward the cylinder head 3, the first protrusion 61 comes into contact with the front wall 4 before the distal end edge 59 comes into contact with the fastening flanges 31 or the bolts 37. As shown in FIG. 10, the first protrusion 61 has, in a part thereof facing the main pipe 21, a groove portion 62 extending along the protruding direction.

Figure 3:
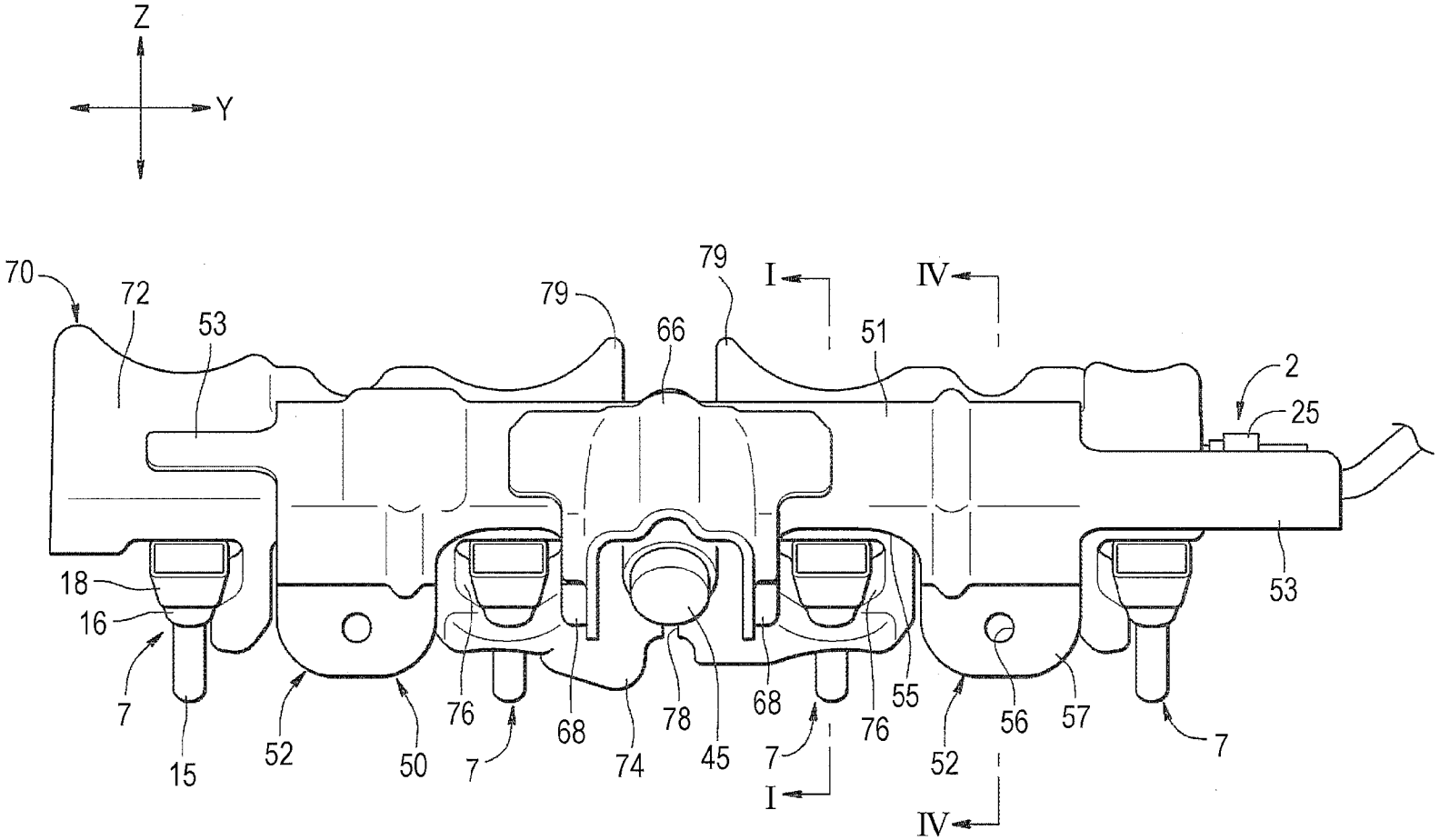
FIG. 3 is a side view of the fuel piping assembly.

As shown in FIG. 9, a cutout portion 64 is formed in the longitudinal center of the proximal end edge 55 of the main body portion 51. A part of the fuel pressure sensor 45 attached to the main pipe 21 is disposed in the cutout portion 64, and contact of the main body portion 51 with the fuel pressure sensor 45 is avoided. One longitudinal end of a long overhang portion 66 having a groove-shaped cross-section is joined by welding to the peripheral edge of the cutout portion 64. The overhang portion 66 is disposed such that the groove-shaped opening faces the second side in the Z direction, and extends from the peripheral edge of the cutout portion 64 in the direction opposite to the cylinder head 3. As shown in FIG. 1 and FIG. 3, the fuel pressure sensor 45 is disposed inside the overhang portion 66 with a gap therebetween. That is, the overhang portion 66 extends along the fuel pressure sensor 45, and covers the side of the fuel pressure sensor 45 opposite to the cylinder head 3. In the longitudinal direction of the main body portion 51, the overhang portion 66 and the first protrusion 61 protrude from positions corresponding to each other in opposite directions.

As shown in FIG. 9 and FIG. 10, parts of the proximal end edge 55 to which both sides of the overhang portion 66 in the main pipe axis direction Y are joined are each provided with a second protrusion 68 extending parallel to the base portions 52 through the second side in the Z direction of the main pipe 21 to the front wall 4. The distal ends of the pair of second protrusions 68 are separated from the front wall 4. In the main pipe axis direction Y, the first protrusion 61 is disposed between the pair of second protrusions 68. The first protrusion 61 and the pair of second protrusions 68 are disposed so as to form the vertices of a triangle as viewed from a direction along the injector axis direction X. The main body portion 51, the base portions 52, and the overhang portion 66 may have beads or recesses and protrusions in position in order to increase the stiffness.

As shown in FIG. 3, in a state where the protective member 50 is fixed to the cylinder head 3, the central two of the four injectors 7 and the branch pipes 22 joined thereto are disposed between the base portions 52 and the second protrusions 68 disposed adjacent thereto in the main pipe axis direction Y. The rightmost one and the leftmost one of the four injectors 7 and the branch pipes 22 joined thereto are disposed on the side of the base portions 52 opposite to the second protrusions 68 in the main pipe axis direction Y.

Figure 11:
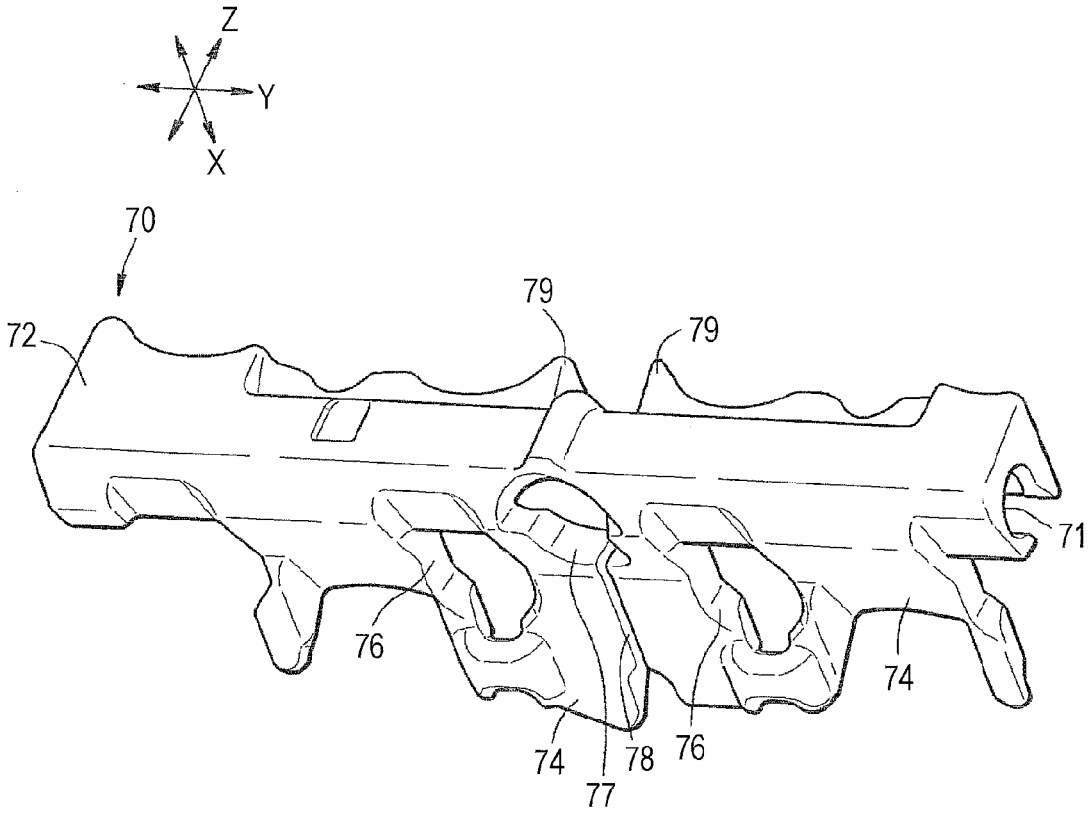
FIG. 11 is a front perspective view of an elastic member.
Figure 12:
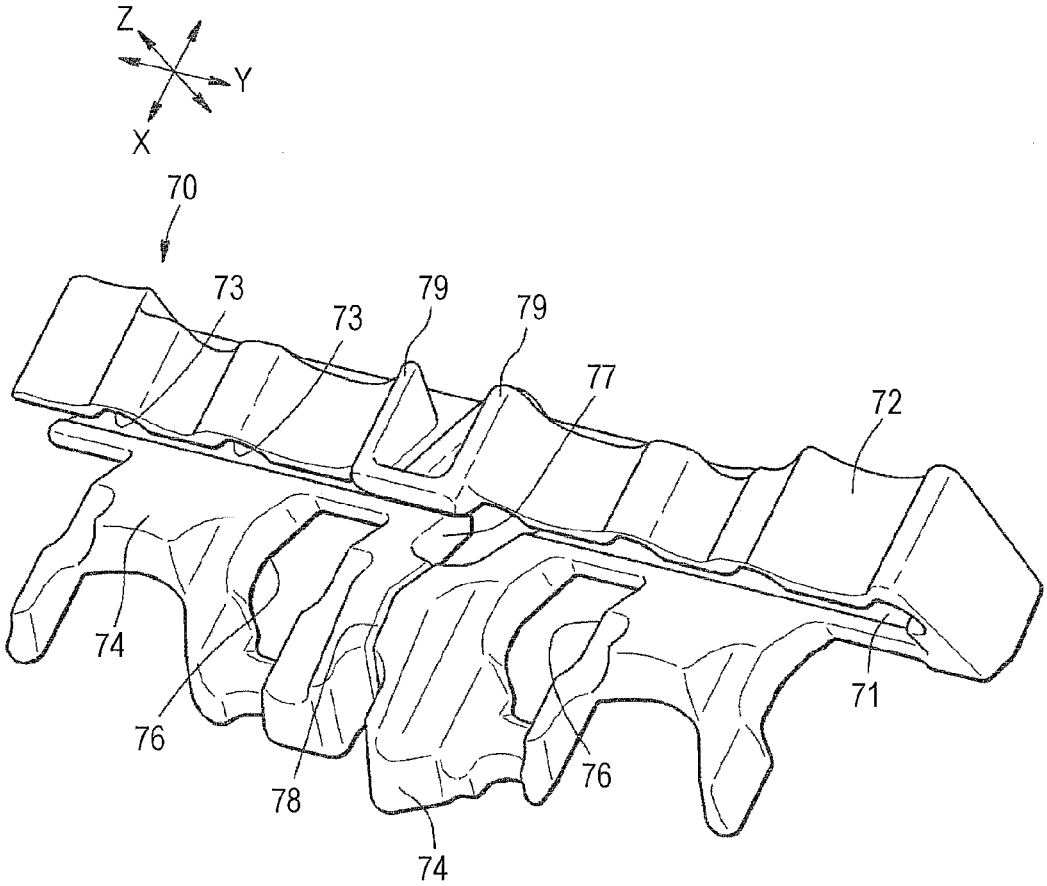
FIG. 12 is a rear perspective view of the elastic member.
Figure 13:
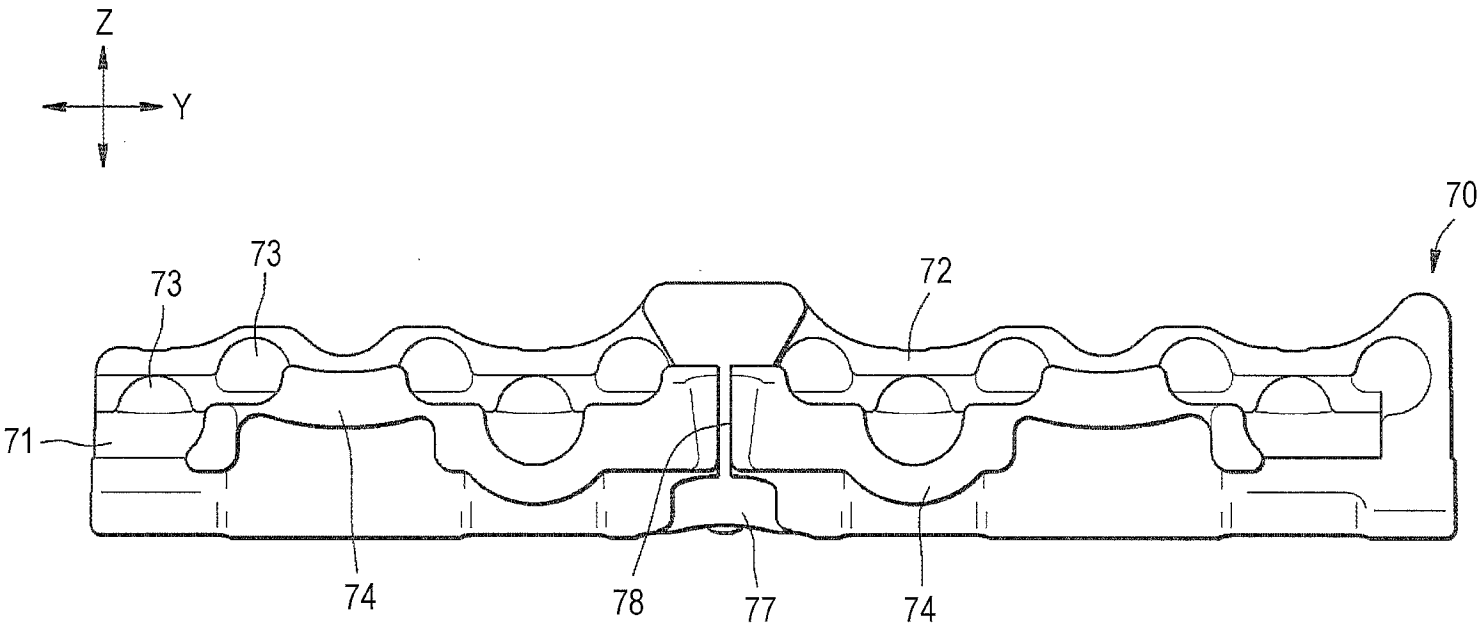
FIG. 13 is a rear view of the elastic member.

As shown in FIG. 1 and FIG. 4, an elastic member 70 formed, for example, of urethane resin is interposed between the protective member 50 and the fuel piping 2. The elastic member 70 is preferably formed of a flexible material having high sound absorbability and high vibration absorbability. As shown in FIG. 11 to FIG. 13, the elastic member 70 has a long base portion 72 in which a slot 71 receiving the main pipe 21 is provided. Recesses 73 for receiving the branch pipes 22 and the fastening flanges 31 are formed on the first side in the Z direction of the slot 71. The main pipe 21, the branch pipes 22, and the fastening flanges 31 are received in the slot 71 and the recesses 73, and the base portion 72 thereby covers the main pipe 21 and so forth from the side opposite to the cylinder head 3. A skirt portion 74 is provided on the second side in the Z direction of the base portion 72 so as to cover the second side in the Z direction of the injectors 7. Connector insertion holes 76 that are through-holes extending in the thickness direction are formed in parts of the skirt portion 74 facing the connectors 18 of the injectors 7. The connectors 18 of the injectors 7 are passed through the connector insertion holes 76, and the terminal portions are exposed below the skirt portion 74. The skirt portion 74 has recesses and protrusions so as to fit the injectors 7 and so as to be in close contact with the injector 7.

A sensor insertion hole 77 is formed in the center in the main pipe axis direction Y of the base portion 72. The sensor insertion hole 77 is a through-hole extending from the slot 71 to the outer surface on the second side in the Z direction of the base portion 72. The skirt portion 74 has a slit 78 extending from the distal end thereof to the sensor insertion hole 77, and is divided in two by the slit 78. The fuel pressure sensor 45 can reach the sensor insertion hole 77 through the slit 78. Therefore, the elastic member 70 can be attached to the fuel piping 2 to which the fuel pressure sensor 45 is attached and that is fastened to the cylinder head 3, so as to cover it from the front.

As shown in FIG. 1 to FIG. 4, the base portion 72 of the elastic member 70 is received in the groove shape of the main body portion 51 of the protective member 50, and the skirt portion 74 is supported from below by the pair of base portions 52 and the pair of second protrusions 68. The elastic member 70 is sandwiched between the first protrusion 61 and the pair of second protrusions 68. A pair of protrusions 79 that sandwich the first protrusion 61 from the main pipe axis direction Y are formed on the outer surface of the base portion 72. The first protrusion 61 is engaged with the pair of protrusions 79, and the elastic member 70 is thereby positioned relative to the protective member 50 in the main pipe axis direction Y.

The above-described fuel piping assembly is formed by first fastening the fuel piping 2 to the cylinder head 3 to which the injectors 7 are attached, next attaching the elastic member 70 to the fuel piping 2, and then fastening the protective member 50 to the cylinder head 3 such that the protective member 50 receives the elastic member 70.

According to the above-described configuration, the protective member 50 prevents a load from being applied to the main pipe 21 at the time of a collision or the like. The first and second fastening portions 32 and 33 of the fuel piping 2 are disposed on the first side in the Z direction of the main pipe 21 in order to facilitate the bolting of the fastening flanges 31 to the cylinder head 3. Therefore, when a load is applied to the main pipe 21 from the front, a rotational moment about the fastening flanges 31 (in the counterclockwise direction in FIG. 1) is prone to be generated in the fuel piping 2. The protective member 50 covers the front of the main pipe 21, and prevents a load from being applied to the main pipe 21. The protective member 50 is fastened to the cylinder head 3 by the base portions 52 on the second side in the Z direction of the main pipe 21, is therefore high in stiffness particularly on the main pipe 21 side, and can prevent a load from being applied to the main pipe 21. The protective member 50 has no fastening portion for fastening to the cylinder head 3 on the first side in the Z direction of the main pipe 21. Therefore, the fastening workload is reduced, and it is not necessary to secure a space for the fastening seat on the cylinder head 3.

When subjected to a load from the side of the cylinder head 3, the protective member 50 rotates while deforming about the fastening portions 57 of the base portions 52 in such a direction that the distal end edge 59 approaches the front wall 4 of the cylinder head 3 (in the clockwise direction in FIG. 1), and the first protrusion 61 collides with the front wall 4 and deforms. The load is absorbed by the deformation of the first protrusion 61. In the case where the load is large, the distal end edge 59 of the main body portion 51 comes into contact with the fastening flanges 31 or the heads of the bolts 37 after the first protrusion 61 collides with the front wall 4 and deforms. The main body portion 51 is wide, and high in stiffness compared to the first protrusion 61, and therefore can resist a larger load than the first protrusion 61. Therefore, the protective member 50 can prevent a load from being applied to the fuel piping 2. The distal end edge 59 brought into contact with the fastening flanges 31 or the heads of the bolts 37 prevents the fastening flanges 31 from coming out of contact with the fastening seat 35.

Since the overhang portion 66 for protecting the fuel pressure sensor 45 is foremost portion of the protective member 50, the overhang portion 66 is most prone to be subjected to a load at the time of a frontal collision. Since the first protrusion 61 is disposed behind the overhang portion 66, the first protrusion 61 efficiently transmits the load applied at the time of a frontal collision, to the cylinder head 3.

The elastic member 70 is in contact with and covers the fuel piping 2 and the injectors 7, and thereby suppresses the vibration of the protective member 50 and the injectors 7. The operating noise of the injectors 7 is thereby reduced.

Figure 14:
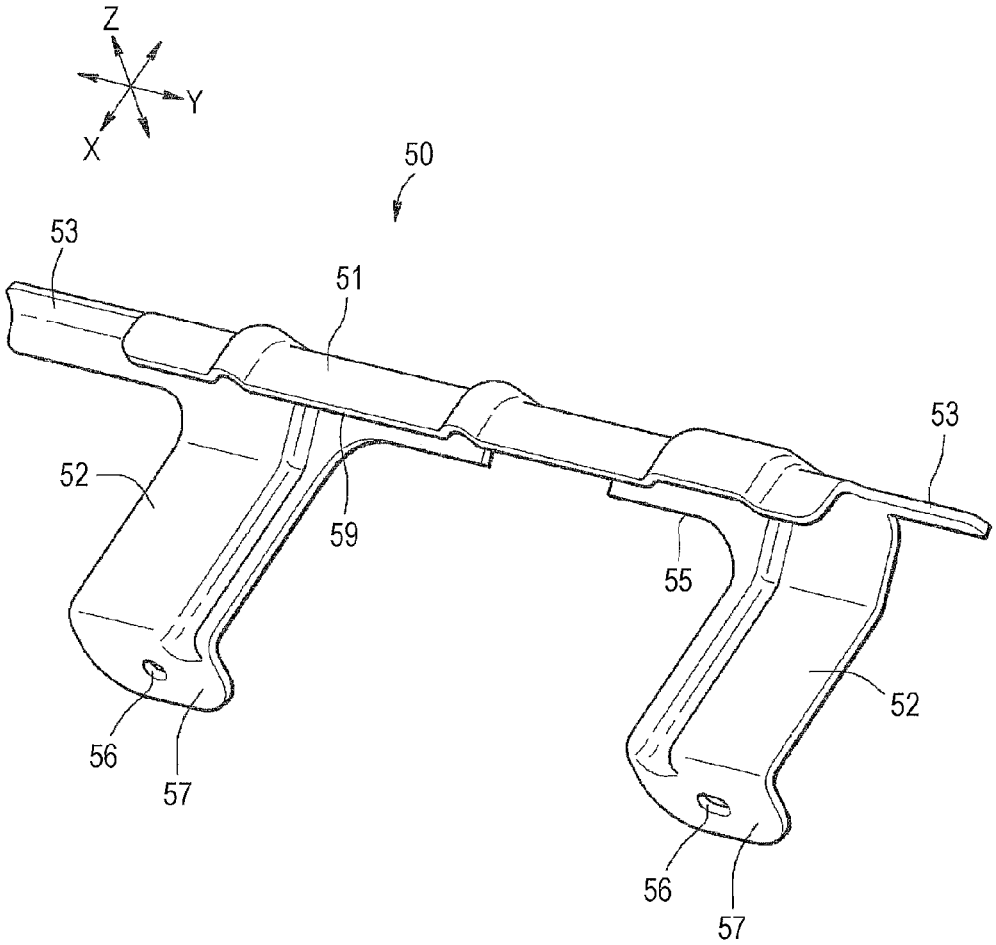
FIG. 14 is a rear perspective view of a protective member according to a modification.
Figure 15:
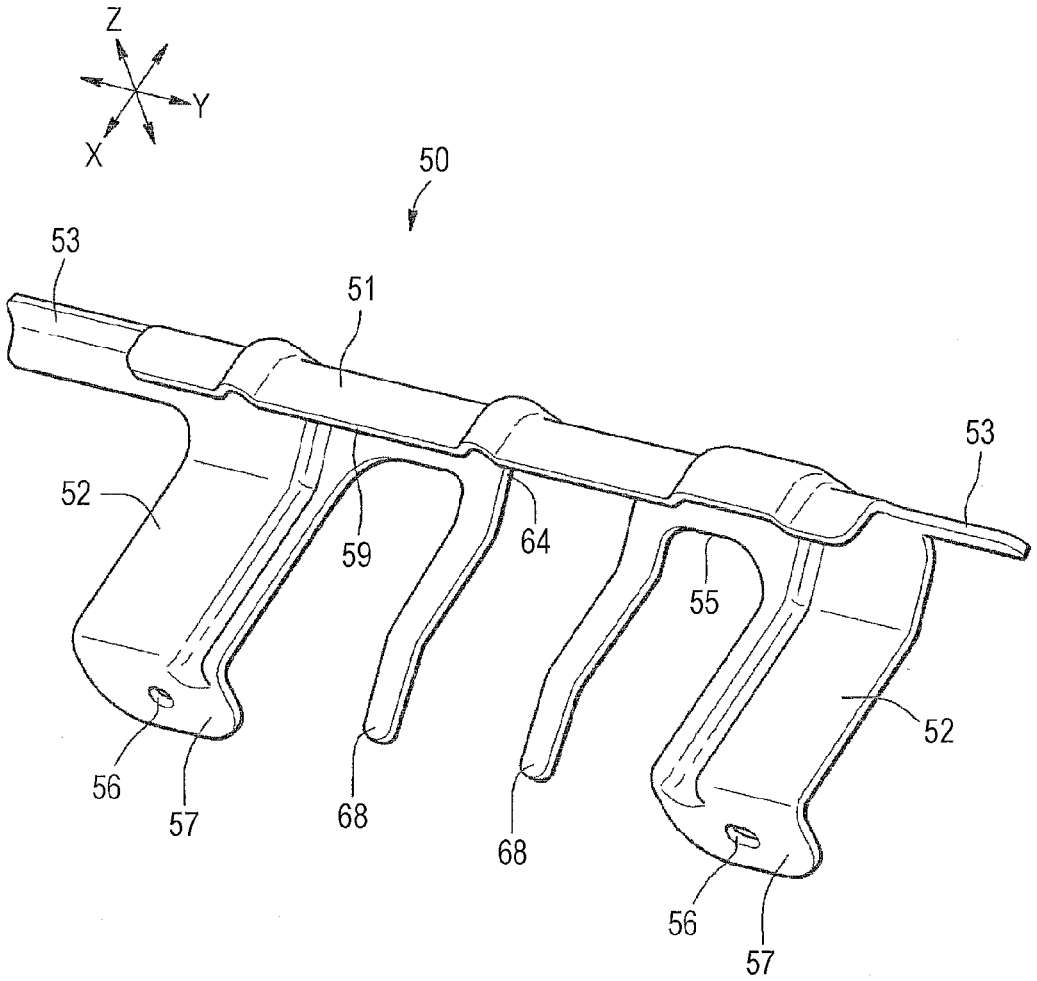
FIG. 15 is a rear perspective view of a protective member according to a modification.
Figure 16:
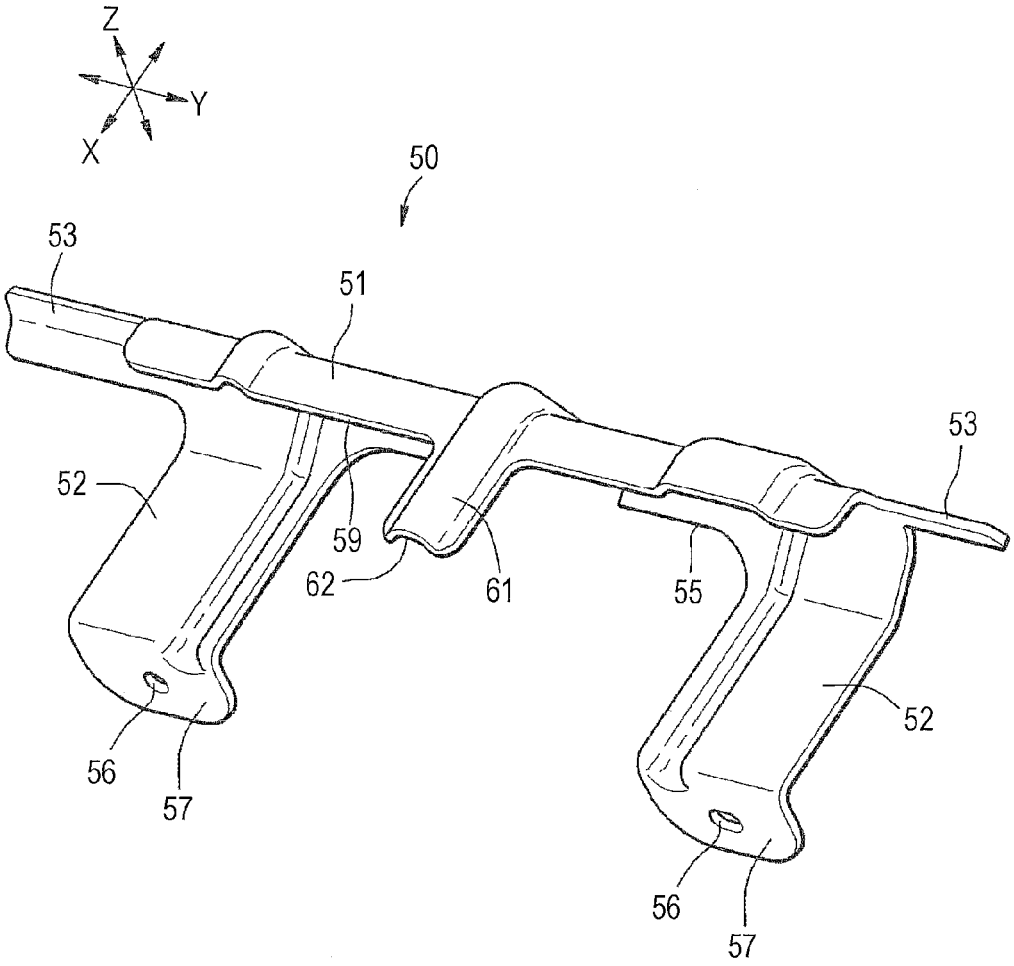
FIG. 16 is a rear perspective view of a protective member according to a modification.

Although a particular embodiment has been described, the present disclosure is not limited to the above-described embodiment, and may be widely modified. For example, in the protective member 50, the first protrusion 61 and the second protrusions 68 are selective elements, and may be omitted in other embodiments. For example, as shown in FIG. 14, the first protrusion 61, the second protrusions 68, and the overhang portion 66 may all be omitted, or, as shown in FIG. 15, the first protrusion 61 and the overhang portion 66 may be omitted, and the second protrusions 68 may be provided. Alternatively, as shown in FIG. 16, the overhang portion 66 and the second protrusions 68 may be omitted, and the protective member 50 may have the first protrusion 61. The number and the positions relative to the main body portion 51 of the base portions 52 may be changed.

In an aspect of the embodiment, an attachment structure of fuel piping (2) that supplies fuel to a plurality of injectors (7) aligned so as to form an injector row in an internal combustion engine main body (3), includes fuel piping (2) that extends parallel to the injector row and that is supported by the internal combustion engine main body with at least one fastening portion (31) joined to the internal combustion engine main body therebetween, and a protective member (50) that is joined to the internal combustion engine main body at at least one base portion (52), that extends so as to cover the side of the fuel piping opposite to the internal combustion engine main body, and a distal end (59) of which forms a free end. When a direction perpendicular to each of the direction (X) of axes of the injectors and the direction (Y) of axis of the fuel piping is referred to as Z direction, all of the at least one fastening portion are disposed on a first side in the Z direction of the axis of the fuel piping, and all of the at least one base portion are disposed on a second side in the Z direction of the axis of the fuel piping.

According to this configuration of the embodiment, the fuel piping has at least one fastening portion at a position offset to the first side in the Z direction, and therefore the fuel piping can be easily fastened to the internal combustion engine main body. However, when a load is applied to the fuel piping owing to a collision or the like, a rotational moment about the fastening portion toward the second side in the Z direction is prone to be generated in the fuel piping. The protective member is joined to the internal combustion engine main body on the second side in the Z direction of the fuel piping and covers the fuel piping, and therefore can appropriately protect the part prone to generate a rotational moment in the fuel piping. The first side in the Z direction of the protective member is a free end, and therefore it is not necessary to secure a space for attachment of the protective member on the internal combustion engine main body.

It is preferable that the fastening portion sandwich the injectors between itself and the internal combustion engine main body.

According to this configuration of the embodiment, the fuel piping can double as an attachment structure of the injectors, and the configuration of the internal combustion engine is simplified.

It is preferable that the distal end of the protective member be disposed so as to face the fastening portion with a gap therebetween, and when a load is applied to the protective member, the protective member deform in a rotational direction about the base portion, and the distal end of the protective member sandwich the fastening portion between itself and the internal combustion engine main body.

According to this configuration of the embodiment, when the protective member is deformed by the load at the time of a collision or the like, the distal end of the protective member sandwiches the fastening portion of the fuel piping between itself and the internal combustion engine main body, and therefore the likelihood that the fastening portion is displaced relative to, or comes off the internal combustion engine main body is reduced.

It is preferable that the protective member have a first protrusion (61) that extends through the first side in the Z direction of the fuel piping toward the internal combustion engine main body, and the first protrusion be disposed such that when a load is applied to the protective member and the protective member deforms in a rotational direction about the base portion, the first protrusion comes into contact with the internal combustion engine main body before the distal end sandwiches the fastening portion between itself and the internal combustion engine main body.

According to this configuration of the embodiment, the first protrusion comes into contact with the internal combustion engine main body and deforms before the distal end of the protective member sandwiches the fastening portion of the fuel piping between itself and the internal combustion engine main body, and the load is thereby absorbed.

It is preferable that an elastic member that covers the fuel piping and that is engaged with the first protrusion be provided between the fuel piping and the protective member.

According to this configuration of the embodiment, the elastic member absorbs the vibration of the fuel piping. Therefore, the vibration of the injectors connected to the fuel piping is suppressed, and the operating noise of the injectors is reduced.

It is preferable that the attachment structure of fuel piping further include a fuel pressure sensor (45) provided so as to protrude from the fuel piping to the second side in the Z direction, the protective member have an overhang portion (66) protruded so as to cover the side of the fuel pressure sensor opposite to the internal combustion engine main body, and the overhang portion and the first protrusion be provided in parts corresponding to each other in the direction of axis of the fuel piping.

According to this configuration of the embodiment, since the overhang portion covers the fuel pressure sensor, the collision load is less likely to be applied to the fuel pressure sensor. The protective member is likely to be subjected to the collision load in the overhang portion provided so as to protrude, and therefore providing the first protrusion and the overhang portion in parts corresponding to each other in the axial direction of the fuel piping facilitates the transmission of the load applied to the overhang portion to the first protrusion.

It is preferable that the protective member have at least two second protrusions (68) that extend through the second side in the Z direction of the fuel piping toward the internal combustion engine main body, and the second protrusions be protruded from both sides of the overhang portion in the direction of axis of the fuel piping.

According to this configuration of the embodiment, the second protrusions are disposed on both sides of the overhang portion, and are thereby disposed on both sides of the fuel pressure sensor, and therefore the fuel pressure sensor is surrounded by the second protrusions, and is less likely to be subjected to a load from the outside.

It is preferable that the fastening portion have a receiving hole that receives an end of the injector, and be fastened with bolts to the internal combustion engine main body at at least two positions that sandwich the injector from a direction along the axis of the fuel piping.

According to this configuration of the embodiment, the fastening portion can stably sandwich the injectors between itself and the internal combustion engine main body.

According to the above configurations of the embodiment, in an attachment structure of fuel piping, it is possible to increase the resistance to collision load and to make it possible to simplify and downsize the structure.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel-piping attachment structure comprising:

a fuel piping defining an axis, the fuel piping extending parallel to an injector row including a plurality of injectors aligned in an internal combustion engine main body, each of the injectors defining an axis;

at least one fastening portion to be joined to the internal combustion engine main body to support the fuel piping with respect to the internal combustion engine main body; and a protective member including at least one base portion to be directly joined to the internal combustion engine main body, the protective member extending so as to cover a side of the fuel piping opposite to the internal combustion engine main body, the protective member having a distal end forming a free end, a direction perpendicular to the axes of the plurality of injectors and the axis of the fuel piping being defined as a Z direction, all of the at least one fastening portion being disposed on a first side with respect to the axis of the fuel piping in the Z direction, all of the at least one base portion being disposed on a second side with respect to the axis of the fuel piping in the Z direction, wherein a bottom of the fuel piping in a height direction of the internal combustion engine is disposed in the second side.

2. The fuel-piping attachment structure according to claim 1, wherein the at least one fastening portion is provided to sandwich the plurality of injectors between the at least one fastening portion and the internal combustion engine main body.

3. The fuel-piping attachment structure according to claim 1, wherein the distal end of the protective member is disposed so as to face the at least one fastening portion with a gap between the distal end and the at least one fastening portion, and wherein, when a load is applied to the protective member, the protective member deforms in a rotational direction about the at least one base portion, and the distal end of the protective member sandwiches the at least one fastening portion between the distal end and the internal combustion engine main body.

4. The fuel-piping attachment structure according to claim 3, wherein the protective member has a first protrusion that extends toward the internal combustion engine main body through the first side in the Z direction, and wherein the first protrusion is disposed such that when a load is applied to the protective member and when the protective member deforms in a rotational direction about the at least one base portion, the first protrusion comes into contact with the internal combustion engine main body before the distal end sandwiches the at least one fastening portion between the distal end and the internal combustion engine main body.

5. A fuel-piping attachment structure comprising:

a fuel piping defining an axis, the fuel piping extending parallel to an injector row including a plurality of injectors aligned in an internal combustion engine main body, each of the injectors defining an axis;

at least one fastening portion to be joined to the internal combustion engine main body to support the fuel piping with respect to the internal combustion engine main body;

a protective member including at least one base portion to be joined to the internal combustion engine main body, the protective member extending so as to cover a side of the fuel piping opposite to the internal combustion engine main body, the protective member having a distal end forming a free end, a direction perpendicular to the axes of the plurality of injectors and the axis of the fuel piping being defined as a Z direction, all of the at least one fastening portion being disposed on a first side with respect to the axis of the fuel piping in the Z direction, all of the at least one base portion being disposed on a second side with respect to the axis of the fuel piping in the Z direction; and an elastic member that covers the fuel piping and that is engaged with the first protrusion, the elastic member being provided between the fuel piping and the protective member, wherein the distal end of the protective member is disposed so as to face the at least one fastening portion with a gap between the distal end and the at least one fastening portion, wherein, when a load is applied to the protective member, the protective member deforms in a rotational direction about the at least one base portion, and the distal end of the protective member sandwiches the at least one fastening portion between the distal end and the internal combustion engine main body, wherein the protective member has a first protrusion that extends toward the internal combustion engine main body through the first side in the Z direction, and wherein the first protrusion is disposed such that when a load is applied to the protective member and when the protective member deforms in a rotational direction about the at least one base portion, the first protrusion comes into contact with the internal combustion engine main body before the distal end sandwiches the at least one fastening portion between the distal end and the internal combustion engine main body.

6. The fuel-piping attachment structure according to claim 4, further comprising:

a fuel pressure sensor provided so as to protrude from the fuel piping to the second side in the Z direction, wherein the protective member has an overhang portion protruded so as to cover a side of the fuel pressure sensor opposite to the internal combustion engine main body, and wherein the overhang portion and the first protrusion are provided in parts that correspond to each other with respect to the Z direction.

7. The fuel-piping attachment structure according to claim 6, wherein the protective member has at least two second protrusions that extend toward the internal combustion engine main body through the second side in the Z direction, and wherein the second protrusions are protruded from two sides of the overhang portion, the two sides of the overhang portion being spaced in the axis of the fuel piping.

8. The fuel-piping attachment structure according to claim 1, wherein each of the at least one fastening portion has a receiving hole to receive an end of each of the plurality of injectors, and wherein the at least one fastening portion is fastened with bolts to the internal combustion engine main body at at least two positions at which each of the plurality of injectors is sandwiched between each of the at least one fastening portion and the internal combustion engine main body along the axis of the fuel piping.

9. The fuel-piping attachment structure according to claim 1, wherein the first side and the second side are opposed about the axis of the fuel piping in the Z direction such that the first side and the second side form opposite sides relative to the fuel piping.

10. The fuel-piping attachment structure according to claim 1, wherein the plurality of injectors are provided on the first side in the Z direction with respect to the axis of the fuel piping.

11. The fuel-piping attachment structure according to claim 1, wherein the distal end extends in a direction along the axis of the fuel piping and the free end has a distal end edge that freely extends along an entirety of the distal end with respect to the axis of the fuel piping.

12. A fuel-piping attachment structure comprising:

a fuel piping defining an axis, the fuel piping extending parallel to an injector row including a plurality of injectors aligned in an internal combustion engine main body, each of the injectors defining an axis;

at least one fastening portion to be joined to the internal combustion engine main body to support the fuel piping with respect to the internal combustion engine main body;

a protective member including at least one base portion to be joined to the internal combustion engine main body, the protective member extending so as to cover a side of the fuel piping opposite to the internal combustion engine main body, the protective member having a distal end forming a free end, a direction perpendicular to the axes of the plurality of injectors and the axis of the fuel piping being defined as a Z direction, all of the at least one fastening portion being disposed on a first side with respect to the axis of the fuel piping in the Z direction, all of the at least one base portion being disposed on a second side with respect to the axis of the fuel piping in the Z direction; and an elastic member that covers the fuel piping provided between the fuel piping and the protective member, the elastic member extending along the entirety of the distal end.

13. The fuel-piping attachment structure according to claim 1, wherein the protective member has a first protrusion that extends toward the internal combustion engine main body through the first side in the Z direction, the first protrusion disposed at a center of the distal end edge.

14. The fuel piping attachment structure according to claim 12, wherein the elastic member includes a plurality of insertion holes that each face a respective injector.

15. The fuel piping attachment structure according to claim 12, wherein the elastic member includes a slot that receives a main pipe of the fuel piping.

* * * * *